United States Patent [19]

Francis et al.

[11] 4,016,527

[45] Apr. 5, 1977

[54] HERMETICALLY SEALED FILM RESISTOR

[75] Inventors: Gaylord L. Francis, Califon; Amedeo J. Morelli, Randolph, both of N.J.

[73] Assignee: North American Philips Corporation, New York, N.Y.

[22] Filed: Sept. 25, 1975

[21] Appl. No.: 616,651

[52] U.S. Cl. ..... 338/274; 29/613; 29/619; 338/276; 338/323; 338/329

[51] Int. Cl.[2] ..... H01C 1/02

[58] Field of Search ..... 338/273, 274, 276, 322, 338/323, 329, 332; 29/613, 619, 621; 174/52 S, 471.1

[56] References Cited

UNITED STATES PATENTS

| | | | |
|---|---|---|---|
| 2,489,409 | 11/1949 | Green et al. | 29/619 X |
| 2,987,813 | 6/1961 | Pope et al. | 29/471 X |

*Primary Examiner*—C. L. Albritton

*Attorney, Agent, or Firm*—Frank R. Trifari; Daniel R. McGlynn

[57] ABSTRACT

A hermetically sealed fixed film resistor including a coupling element of soft alloy material between the resistive element and the leads for providing strain relief. The resistive element is composed of a resistive film having coated ends composed of a refractory metallic material for providing reliable electrical and mechanical connection to the coupling element.

24 Claims, 2 Drawing Figures

HERMETICALLY SEALED FILM RESISTOR

The invention relates to electronic components, particularly hermetically sealed fixed film resistors, and further relates to end coatings for such resistors.

Hermetically sealed electronic components are known for diodes and capacitors such as in U.S. Pat. No. 3,458,783. Such components are utilized in hostile environments which could affect the performance characteristics of such components.

U.S. Pat. Nos. 3,810,068 and 3,307,134 describe prior art versions of a hermetically sealed impedence element. Such prior art components utilize ceramic frits or cermets to form the electrical and mechanical connection between the resistive element and the leads. Such connections may be disadvantageous in certain high reliability applications. Furthermore, the use of a magnesium reaction terminal requires a different manufacturing process than is widely used in the industry.

SUMMARY OF THE INVENTION

It is an object of the invention to provide a hermetically sealed fixed film resistor.

It is another object of the invention to provide a film resistor having a solderable refractory material as a metal end coating.

It is yet another object of the invention to provide a hermetically sealed fixed film resistor that utilizes proven technology for forming electrical and mechanical connections to the resistive element. It is still another object of the invention to provide a coupling element between an electrical component in a hermetically sealed container which provides strain relief from the differential shrinking between the container and the resistive element at different temperatures.

The present invention provides a hermetically sealed electrical device; including:

- an electrical component;
- a substantially cylindrical glass element surrounding said component and providing a hermetic seal;
- a pair of flexible metal leads axially extending from said device; and
- a coupling element between said component and said leads, comprising a solderable preform of a soft alloy for providing strain relief at each end.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

BRIEF DESCRIPTIONS OF THE DRAWINGS

FIG. 1 is a cutaway cross-sectional view of a hermetically sealed resistor according to the present invention; and FIG. 2 is an exploded view of the resistor shown in FIG. 1.

DESCRIPTION OF THE PREFERRED EMBODIMENTS

Figure 1:
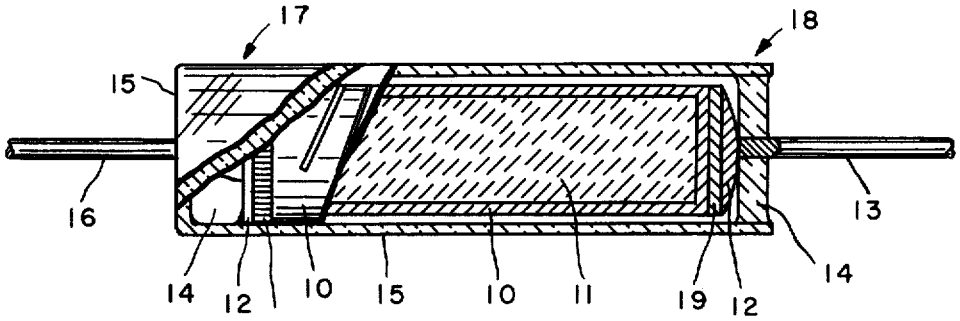

Referring now to FIG. 1, there is shown a cross-sectional view of a hermetically sealed fixed film resistor according to the present invention. The resistor is formed from a resistive element consisting of a resistive film 10 coated on the entire surface of a solid cylinderical core 11.

The ends of the resistive element 10, 11 are coated with a metallic end coating 19. A solder or braze metal alloy preform 12 is provided adjacent to the two ends of the resistive element for making an electrical and mechanical connection between the end coating 19 of the resistive element 10, 11 and the leads 13, 16.

Figure 2:
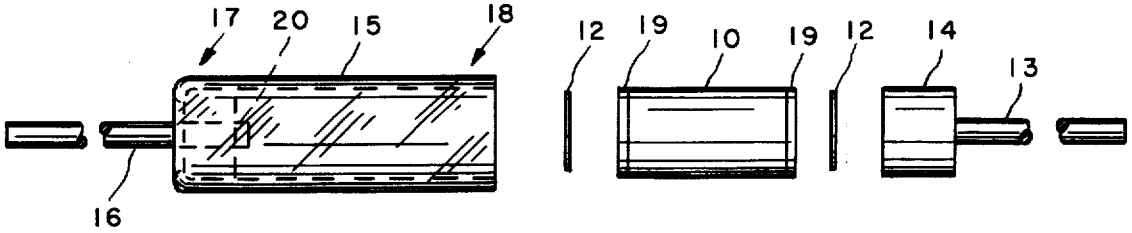

FIG. 2 is an exploded view of the resistor shown in FIG. 1, and more clearly indicates the metallic end coating 19, and preforms 12.

The preform 12 is selected to have an appropriate melting point consistent with the manufacturing process.

Flexable copperclad steel leads 13 and 16 are provided which extend axially from the resistive element 10, 11. Lead 13 is shown attached to an enlarged stud or head 14 which makes electrical contact with the resistive element through the preform 12. The head 14 may also comprise a glass bead for forming a fused glass seal of the electrical component.

The resistive element 10, 11, preforms 12, and head 14 are encapsulated in a glass tube or bottle 15. The embodiment of a glass bottle 15 is shown in FIG. 1. A glass bottle 15 is defined as a glass cylinder having one end closed in an air-tight seal. A copper clad steel lead 16 is heat-sealed to the closed end 17 of the bottle 15 prior to assembly, with the lead 16 protruding into the interior of the bottle 15 for making electrical contact with the preform 12. After the solder preform 12, the resistive elements 10, 11, preform 12, and head 14 of lead 13 are inserted into the bottle 15, the open end 18 of the bottle 15 is heat-sealed, thereby forming an air-tight enclosure of the resistive element.

The studded lead 13 is made by cutting a Dumet wire coated with a borate compound to a predetermined length to form the head 14, and welding a copper-clad steel wire 13 to one end. It is also possible to utilize a heavily oxidized Dumet wire for certain applications. By pretreating the Dumet wire in this fashion a good heat seal or the head 14 to the glass bottle 15 is made possible when heat sealing the glass bottle 15. The leadwire 13 should protrude into the interior of the glass bottle by 0.000–0.020 in preferably about 0.005 in., for making electrical connection with the solder preform 12.

The resistive film 10 refers to a electrically conductive film with predetermined resistive properties, which may be cut or spiralled to a particular resistive value by known techniques in the art of film resistors. The film may also be left without cutting or spiralling to be formed after assembly of the device.

The composition of the resistive film is selected so that the characteristics of the film are consistent with the assembly process for the device.

The resistive core 11 consists of a refractory material which is compatible in terms of the temperature coefficent of linear expansion with the glass tube or bottle 15. The resistive film 10 consists of a cermet or thin metal film which completely covers the core 11. A low-resistive metallic coating 19 is deposited on the ends of the resistive element 10, 11, over the resistive film 10, and may overlap the sides by approximately 0.002 to 0.020 inches. This metallic end coating 19 must also be compatible with the resistive film 10 in terms of heat-expansive properties, i.e. have a suitable temperature coefficients of linear expansion.

Many end coating materials which are solderable react with the resistive film at the heat-sealing temperature of the glass, or react slowly at elevated temperatures causing some drift in the resistive properties or electrical characteristics of the electronic component as a function of temperature and time. Examples of such unsuitable coating materials are copper and silver. The drift in electrical characteristics is highly undesireable for precision electronic components.

The use of refractory metals such as nickel, cobalt, chrome, molybdenum, or tungsten, as an end coating material has been found to provide more satisfactory results. Nickel is preferred because of its readiness to solder or braze without flux, its relatively low resistivity, as well as being convenient to work with.

It is also possible to utilize a barrier layer when using silver, copper, or gold over the end portion of the resistive film 10. The "barrier layer" refers to the possibility that the refractory end coating barrier material may extend beyond the silver or gold coating into the resistive film 10 itself. The barrier layer thus acts as a barrier to the diffusion of more active atoms into the resistive film 10.

Various tests have been made of specific materials as end coatings at specific temperatures over long periods of time (e.g. 165 hours at 185° C). The resistive readings were taken before and after the heat aging process and the precentage change in resistive value due to heat aging were calculated. The results of these tests are shown in the table below.

| COPPER ENDS | MOLY-SILVER ENDS | NICKEL ENDS |
|---|---|---|
| Percent in resistivity 1.89% change due to Bake | 0.191% | 0.142% |

The solder preforms 12 provide good electrical contact between the resistor element and the outside leads of the hermetically sealed package. These preforms 12 must provide good wettability to the leads and end terminations of the resistive element 10, 11 when exposed to appropriate temperatures.

During one heat-sealing process for assembling the device heat is only applied to one end of the assembly, and accordingly the two solder or brazing preforms in the assembly are exposed to at least two different temperatures levels. It may therefore be necessary to utilize two different solder preforms having different characteristic temperatures of fusing for obtaining optimum properties of the resulting resistor.

These preforms 12, as opposed to the prior art ceramic or cermet, provide strain relief due to soft, compliant nature of the solder composition. Such strain may arise due to the differential shrinking between the glass bottle 15 and the resistive element 10, 11 during a temperature change.

The core 11 is composed of a Fosterite ceramic or other high expansion ceramic in the range of 8.5 – 10.5 ppm per C°.

While the invention has been illustrated and described as embodied in a Hermetically Sealed Film Resistor, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitutes essential characteristics of the generic or specific aspects of this invention and, therefore, such adaptions should and are intended to be comprehended within the meaning and range of equivalence of the following claims.

What is claimed as new and desired to be protected by Letters Patent is set forth in the appended claims.

1. A hermetically sealed electrical device comprising an electrical component comprising a core element coated with a resistive film material, and a refractory metal coating over the ends of said core element in electrical contact with said resistive film material;

a substantially cylindrical glass element surrounding said component and providing a hermetic seal;

a pair of flexible metal leads axially extending from said device; and a coupling element between said component and said leads, comprising a solderable preform of a soft alloy for providing strain relief from the differential shrinking between said glass element and said electrical component at each end.

2. The device as defined in claim 1, wherein said refractory metal coating comprises nickel.

3. The device as defined in claim 1, wherein said refractory metal coating comprises cobalt.

4. The device as defined in claim 1, wherein said refractory metal coating comprises molybdenum.

5. The device as defined in claim 1, wherein said refractory metal coating comprises tungsten.

6. The device as defined in claim 1, wherein said refractory metal coating comprises chrome.

7. The device as defined in claim 1, wherein said core element is composed of a Forsterite ceramic.

8. The device as defined in claim 1, wherin said leads comprise an enlarged head in said device for providing a hermetic seal with said glass element, and an electrical contact with said solderable preform.

9. The device as defined in claim 1, wherein said enlarged head comprises a glass bead fused to said glass element.

10. The device as defined in claim 1, comprising a metal coating over said refractory metal coating and making contact with said coupling element, said refractory metal coating serving as a barrier layer.

11. The device as defined in claim 10, wherein said barrier layer comprises nickel.

12. The device as defined in claim 10, wherein said barrier layer comprises cobalt.

13. The device as defined in claim 10, wherein said barrier layer comprises molybdenum.

14. The device as defined in claim 10, wherein said barrier layer comprises chrome.

15. The device as defined in claim 10, wherein said barrier layer comprises tungsten.

16. The device as defined in claim 10, wherein said metal coating contacting said coupling element comprises silver.

17. The device as defined in claim 10, wherein said metal coating contacting said coupling element comprises gold.

18. The device as defined in claim 10, wherein said metal coating contacting said coupling element comprise copper.

19. An electrical device comprising:

an electrical component having a coating of resistive film material over at least a portion thereof;

a metal coating over the ends of said component and in electrical contact with said resistive film material;

a solderable preform abutting at least a portion of said metal coating and making electrical connection therewith;

a hermetically sealed enclosure surrounding said component; and a lead having an enlarged head contiguous with said enclosure and abutting said solderable preform and extending from said enclosure.

20. The device as defined in claim 19, wherein said metal coating comprises a refractory metal.

21. An electrical device comprising:

an electrical component having a coating of resistive film material over at least a portion thereof;

an enclosure surrounding said component;

a first metal coating over the ends of said component and in electrical contact with said resistive film material;

a strain-relief element abutting at least a portion of said first metal coating and making electrical connection therewith;

a lead having an enlarged head contiguous with said enclosure and abutting said strain-relief element and extending from said enclosure.

22. The device as defined in claim 21, wherein said first metal coating comprises a refractory metal.

23. The device as defined in claim 22, further comprising a second metal coating between said first metal coating and said strain-relief element.

24. The device as defined in claim 21, wherein said enclosure is hermetically sealed.

* * * * *